US008646229B2

(12) United States Patent
Grunewald et al.

(10) Patent No.: US 8,646,229 B2
(45) Date of Patent: Feb. 11, 2014

(54) CURTAIN WALL EXTERNAL SUPPORT SYSTEM

(75) Inventors: Fred A. Grunewald, Rockwall, TX (US); James P. Clark, Terrell, TX (US); William T. Morrison, Limestone, TN (US)

(73) Assignee: Oldcastle BuildingEnvelope, Inc., Dallas, TX (US)

( * ) Notice: Subject to any disclaimer, the term of this patent is extended or adjusted under 35 U.S.C. 154(b) by 0 days.

(21) Appl. No.: 12/842,466

(22) Filed: Jul. 23, 2010

(65) Prior Publication Data

US 2011/0192110 A1 Aug. 11, 2011

Related U.S. Application Data

(63) Continuation of application No. 11/142,072, filed on Jun. 1, 2005, now Pat. No. 7,818,931.

(60) Provisional application No. 60/576,017, filed on Jun. 1, 2004, provisional application No. 60/638,149, filed on Dec. 21, 2004.

(51) Int. Cl.
*E04B 2/96* (2006.01)
*E04F 10/00* (2006.01)

(52) U.S. Cl.
USPC ..... 52/235; 52/74; 52/745.21; 52/844

(58) Field of Classification Search
USPC ..... 52/235, 73, 74, 75, 76, 77, 78, 844, 52/745.21
See application file for complete search history.

(56) References Cited

U.S. PATENT DOCUMENTS

| | | | | |
|---|---|---|---|---|
| 3,038,568 | A | 6/1962 | Morgan | |
| 4,055,923 | A | 11/1977 | Biebuyck | |
| 4,644,717 | A | 2/1987 | Biebuyck | |
| 4,773,193 | A | 9/1988 | Biebuyck et al. | |
| 4,899,508 | A | 2/1990 | Biebuyck | |
| 5,036,637 | A | 8/1991 | Biebuyck | |
| 5,058,344 | A | 10/1991 | Biebuyck | |
| 5,271,204 | A * | 12/1993 | Wolf et al. | 52/836 |
| 5,319,882 | A | 6/1994 | Biebuyck | |
| 5,469,665 | A | 11/1995 | Biebuyck | |

(Continued)

FOREIGN PATENT DOCUMENTS

| | | | |
|---|---|---|---|
| EP | 0764749 | A1 | 3/1997 |
| EP | 1149961 | A2 | 10/2001 |

(Continued)

*Primary Examiner* — Robert Canfield
*Assistant Examiner* — Jessie Fonseca
(74) *Attorney, Agent, or Firm* — Winstead PC

(57) ABSTRACT

A curtain wall mounting system adapted for cantilevered support of at least one structure outwardly therefrom. The curtain wall mounting system including an anchor plate having dual plates and adapted for integral mounting with a curtain wall web section. The curtain wall web section includes one of a hollow tongue web extending outwardly of a curtain wall vertical mullion in a first direction and an integrally formed flange region extending outwardly of the curtain wall vertical mullion in the first direction. The curtain wall web section includes a first set of fastening apertures oriented transversely to the first direction and formed. The anchor plate includes at least one generally planer body portion having a first set of mating apertures adapted for alignment in registry with the first set of fastening apertures of the web. The anchor plate further having a second set of apertures adapted for securing structures outwardly therefrom.

14 Claims, 9 Drawing Sheets

(56) References Cited

U.S. PATENT DOCUMENTS

| | | | | |
|---|---|---|---|---|
| 5,930,955 | A | 8/1999 | Biebuyck | |
| 6,158,182 | A | 12/2000 | Biebuyck | |
| 6,226,940 | B1 | 5/2001 | Biebuyck | |
| 6,421,966 | B1 | 7/2002 | Braunstein et al. | |
| 6,438,913 | B1 * | 8/2002 | Ishikawa et al. | 52/235 |
| 6,550,196 | B2 | 4/2003 | Braybrook | |
| 6,598,361 | B2 | 7/2003 | Ting | |
| 6,715,248 | B2 | 4/2004 | Biebuyck | |
| 6,993,873 | B2 | 2/2006 | Biebuyck et al. | |
| 7,536,832 | B2 * | 5/2009 | DeYoung | 52/74 |
| 2004/0031220 | A1 | 2/2004 | Hocker et al. | |
| 2004/0079038 | A1 | 4/2004 | Crooker | |
| 2005/0284053 | A1 * | 12/2005 | Grunewald et al. | 52/235 |
| 2008/0098665 | A1 * | 5/2008 | DeYoung | 52/75 |

FOREIGN PATENT DOCUMENTS

| | | |
|---|---|---|
| GB | 2313857 | 12/1997 |
| GB | 2365451 | 2/2002 |
| IE | 82950 B3 | 7/2003 |
| NL | 1020468 C2 | 11/2003 |

* cited by examiner

CURTAIN WALL EXTERNAL SUPPORT SYSTEM

CROSS REFERENCE TO RELATED APPLICATIONS

This application is a continuation of U.S. patent application Ser. No. 11/142,072 (now U.S. Pat. No. 7,818,931), filed Jun. 1, 2005. U.S. patent application Ser. No. 11/142,072 claims the benefit of, and incorporates by reference the entirety of U.S. Patent Appl. 60/576,017 filed Jun. 1, 2004 as well as U.S. Patent Application 60/638,149 filed Dec. 21, 2004.

BACKGROUND OF THE INVENTION

1. Technical Field

The present invention relates in general to curtain wall systems and, more particularly, but not by way of limitation, to a curtain wall system incorporating a vertical mullion for engagement with an exterior mounting anchor configured to mate therewith in support of a structure, such as a sunshade, or the like, outwardly of the curtain wall.

2. History of Related Art

Curtain wall systems are well known in the building industry and generally incorporate a plurality of vertical and horizontal load bearing members designed for the support of panels which are both functional as well as aesthetically pleasing. Oftentimes the panels are glass, providing a substantially transparent finished curtain wall. Due to this transparency, it is sometimes desirable to mount shading structures above the panels. Obviously, the type of and/or weight of material disposed outwardly of any curtain wall, and supported thereby, could have a direct bearing upon the design of the curtain wall and/or the design of the curtain wall interconnection system that accommodates the outwardly mounted structures.

For reference purposes, representative glass curtain wall systems illustrating various commercially-acceptable design aspects are set forth and described in U.S. Pat. No. 4,005,923 issued on Nov. 1, 1977. This system, assigned to the assignee of the present invention, is representative of certain curtain wall constructions. Likewise, U.S. Pat. No. 4,899,508, which issued on Feb. 13, 1990 and assigned to the assignee of the present invention, teaches yet another paneled curtain wall system addressing aspects of curtain wall design and construction. The utility of curtain wall assemblies is well known, and curtain walls have received wide-spread commercial acceptance.

Glass panel curtain walls are very popular and are often designed and constructed with extruded aluminum members in association with steel mullions. The various components of the curtain wall system are fabricated at factories and either preassembled into subassemblies or transported to job sites where on site assembly occurs. In either case, the actual construction of the curtain wall occurs at the job site, and it is very important that consideration be given to efficiencies in construction from both safety as well as reliability standpoints. The vertical and horizontal mullions may also be constructed in predetermined shapes and lengths and assembled piece by piece into a building grid. The structural interconnection between the mullions and/or anchors extending outwardly from the mullions are, in many designs, configured for the most appropriate structural interconnection deemed appropriate by the designer and/or structural engineer.

As referenced above, structures disposed outwardly of glass panel curtain wall systems include sunshades. Such devices have been installed on buildings and over windows for many years. In the main, these structures are mounted outwardly from, secured to, and supported by the structural curtain wall mullions. In particular, the vertical mullion of the curtain wall is typically used to support the mounting bracket or anchor for the external structure such as the aforementioned sunshade. The assignee of the present invention has, for many years, installed sunshade systems externally of curtain wall systems utilizing various structural interconnection members. Likewise, other building systems have incorporated such sunshade support structures. It is well known that the manufacture of curtain wall systems includes both selective design aspects that are incorporated during the manufacturing process of curtain wall sections, as well as installation applications that are provided for during the application and/or installation process.

One of the most popular curtain wall designs in contemporary building is that of the generally contiguous panels members such as glass. The glass panels may be in a single or multiple pane configuration. Major considerations in the use of panel members are, of course, structural integrity, aesthetics, and the sealing to resist water infiltration and drainage of water that has infiltrated the panel members. In order to maintain such structural integrity as necessary to meet building codes, design consideration must be given to all loads upon the curtain wall system. Not the least of these loads is the portion of the curtain wall system that supports not only the panel members but any members and/or structures outwardly disposed therefrom. For example, a support member or anchor may extend from the curtain wall system for supporting sunshades and the like.

To date, many designs for cantilevered anchors extending outwardly from the vertical mullions of the curtain wall system have implemented configurations that include fasteners that penetrate through a front face of the vertical mullion and into a void. As shown in U.S. Pat. No. 6,421,966, a sunshade is anchored to a vertical mullion via a plurality of fasteners that penetrate a front face of the vertical mullion and are secured through the void of the vertical mullion. The fasteners are oriented in-line with tension forces created by the sunshade. In this configuration, it may be seen that the fasteners above the support brackets will be placed in tension relative to all loads applied thereto due to the weight of the loads thereon.

Another design is that set forth shown and described in co-pending U.S. Patent Application Ser. No. 60/576,017 filed on Jun. 1, 2004. In that application, there is disclosed a curtain wall system wherein a plurality of holes are provided in a web section of a vertical curtain wall system allowing a cantilever member to be supported by a plurality of fasteners extending therethrough in a manner generally perpendicular to tension forces. In yet another embodiment of that invention, the cantilevered support member is specifically configured to matingly engage the vertical mullion web extending outwardly of and incorporating a portion of the curtain wall. In accordance with yet another aspect of that invention, a system for retrofitting curtain walls with cantilever support anchors for the support of sunshades and the like is provided wherein a series of apertures transverse from a front face of a vertical mullion may be formed facilitating the coupling with and structural security of the cantilevered support anchors. In one embodiment, the anchor itself may be pre-fabricated and a pre-selected hole pattern may be provided therewith. In this manner, a template may be afforded by pre-drilling predetermined web sections of a vertical mullion therein and assembling the anchor thereto.

SUMMARY OF INVENTION

The present invention relates to a curtain wall system incorporating an exterior mounting anchor configured to mate with a vertical mullion of the curtain wall. More particularly, one aspect of the present invention includes a curtain wall system wherein a web section of a vertical curtain wall system is adapted to receive a cantilever member and supported by a plurality of fasteners extending transversely therethrough.

In yet another embodiment, the web section includes a hollow tongue portion of the mullion and the cantilevered support member is specifically configured for insertion in, and mating engagement of, the hollow tongue portion of the vertical mullion. In that embodiment, the support member includes elongate shoulder regions extending along opposite sides thereof for abutting engagement with a face of the hollow tongue mullion.

In a further embodiment, one aspect of the present invention relates to a curtain wall system wherein a plurality of holes are provided in a vertical mullion web extending outwardly of and incorporating a portion of the curtain wall allowing the cantilever member to be supported by a plurality of fasteners extending therethrough in a manner generally perpendicular to tension forces. The cantilevered support member may be specifically configured to matingly engage the web.

In accordance with yet another aspect of the present invention, a system for retro-fitting curtain walls with cantilever support anchors for the support of sunshades and the like is provided wherein a series of apertures transverse from a front face of a vertical mullion may be formed facilitating the coupling with and structural security of the cantilevered support anchors.

In one embodiment, the anchor itself may be pre-fabricated and a pre-selected hole pattern may be provided therewith. In this manner, a template may be afforded by pre-drilling predetermined web sections of a vertical mullion therein and assembling the anchor thereto.

In yet another embodiment, the present invention relates to an anchor that is configured to matingly engage the web of the vertical mullion. The vertical mullion has a plurality of apertures for facilitating fasteners extending therethrough in a pre-selected hole pattern for structural interconnectivity therewith. In this manner, the fasteners at the anchor attachment relative to the vertical mullion web are providing support in shear rather than in tension.

In yet another embodiment, the fasteners are threaded members such as bolts that provide, due to their thickness and placement relative to the anchor and vertical mullion web, sufficient structural support for the weight applied to the anchor.

In yet another embodiment, as described below, trim plates may be utilized in conjunction with the anchor and vertical mullion web to cover the interconnectivity between and provide and aesthetically pleasing appearance thereto.

BRIEF DESCRIPTION OF THE DRAWINGS

Further advantages and specific details of the present invention will become apparent hereinafter from the detailed description given below in conjunction with the following drawings.

DETAILED DESCRIPTION OF THE INVENTION

Embodiments of the present invention provide a curtain wall system anchor adapted for supporting external cantilevered loads relative to the curtain wall system. The loads may include external structures, such as sunshades. The anchor is secured to and supported by the curtain wall system by transverse fasteners extending transversely through a hollow tongue mullion portion of the curtain wall system.

Figure 1:
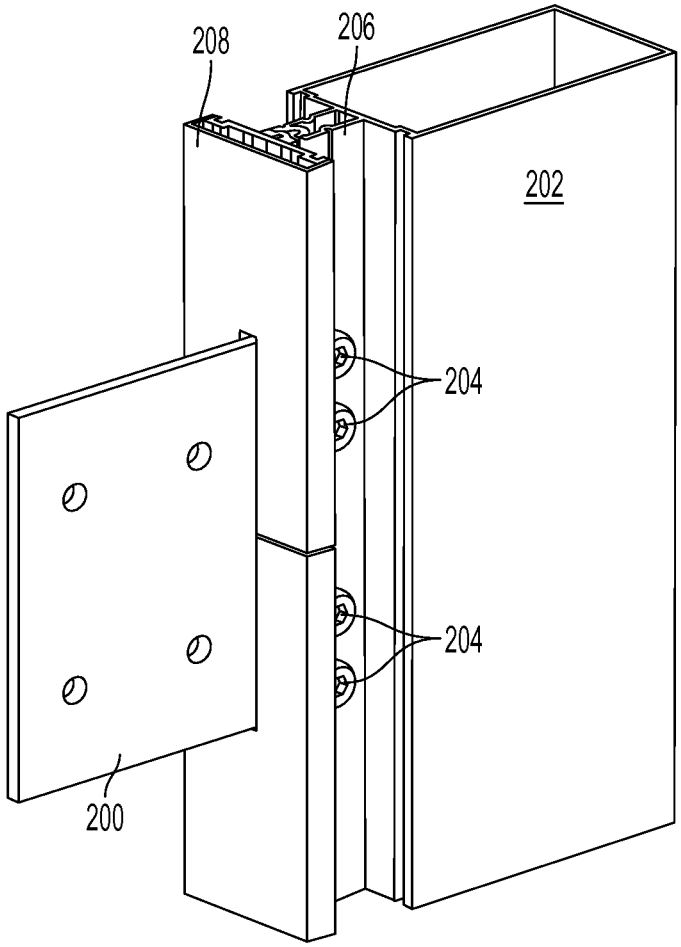
FIG. 1 is a perspective view of a support anchor and vertical mullion in accordance with an embodiment of the present invention.

Referring now to FIG. 1, a support anchor 200 and vertical mullion 202 in accordance with an embodiment of the present invention is illustrated. The support anchor 200 is secured to the vertical mullion 202 with fasteners 204 oriented transversely to tension placed on the support anchor 200. The fasteners 204 secure the support anchor 200 via apertures placed in a hollow tongue, web portion 206 of the vertical mullion 202. This aspect will be illustrated most clearly in FIG. 3. A face cover 208 may be oriented to cover a portion of the vertical mullion 202 and the support anchor 200, as illustrated most clearly in FIG. 2.

Still referring to FIG. 1, the support anchor 200 may be utilized to secure sunshades or various other mechanisms to a curtain wall system. The support anchor 200 may be oriented at any portion of the vertical mullion 202 and is not restricted to being fastened to the curtain wall system at an intersection of the vertical mullion and horizontal member.

Figure 2:
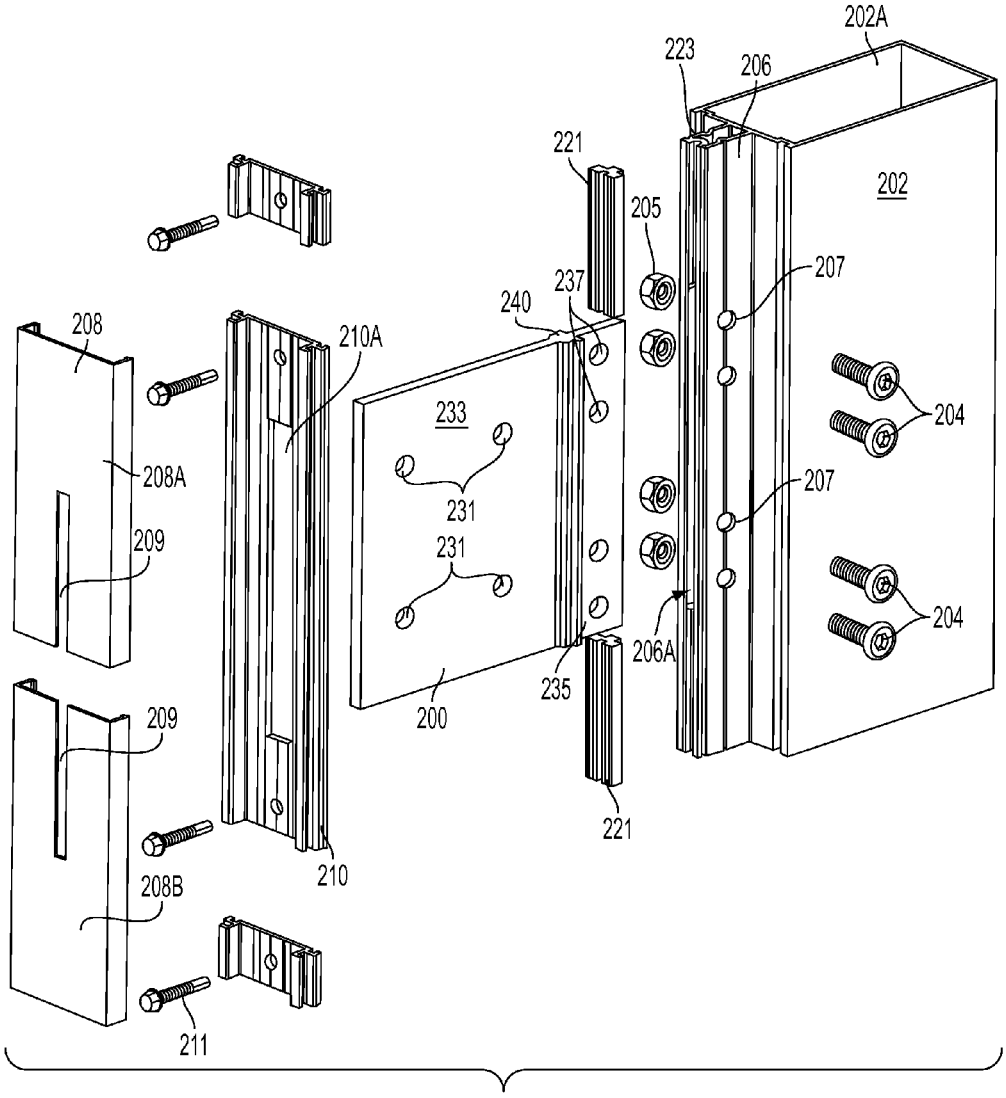
FIG. 2 is an assembly diagram of the support anchor and vertical mullion of FIG. 1.

Referring now to FIG. 2, an assembly diagram of the support anchor 200 and vertical mullion 202 is shown. The support anchor 200 is attached to the hollow tongue web portion 206 of the vertical mullion 202 via fasteners 204. The face cover 208 is attached by snapping over a pressure plate 210. The pressure plate 210 is attached to the front face 206*a* of the web portion 206 via fasteners 211. By attaching the support anchor 200 to the vertical mullion 202 in this manner, no penetration is made through the vertical mullion into a mullion void 202A thereof. By not penetrating the void 202A, additional sealing of the vertical mullion 202 is not necessary when securing the support anchor 200.

Referring still to FIG. 2, the face cover 208 is shown to be formed of upper and lower portions 208A and 208B, each having a central slot 209 formed therein. The central slot 209 in upper and lower portions 208A and 208B, respectively, is sized to receive the support anchor 200 extending therethrough. Likewise, the pressure plate 210 is constructed with a central slot 210A adapted for alignment with slot 209 in receipt of the support anchor 200 therethrough.

Continuing to refer to FIG. 2, the support anchor 200 is further constructed with a plurality of external mounting apertures 231 in an external mounting surface 233 thereof. An internal mounting surface 235 adapted for receipt within the hollow tongue web portion 206 likewise contains a series of internal mounting apertures 237. The apertures 237 are adapted for registry with the apertures 207 of the hollow tongue mullion web portion 206 to therein receive the fasteners 204 therethrough. Likewise, the support anchor 200 is formed with an elongate shoulder region 240 which extends along both sides and the full length thereof. The shoulder region 240 is adapted for abuttingly engaging the face 206A of the hollow tongue web portion 206 once surface 235 is mounted therein. In this manner, weight applied to the support anchor 200 through apertures 231 outwardly of the vertical mullion 202 is transferred directly to the vertical mullion 202 by the abutting engagement of the shoulder region 240 thereagainst, as well as the securement thereof through the fasteners 204.

Referring still to FIG. 2, the assembly diagram also illustrates a series of threaded members 205 which are adapted for receiving and securing the fasteners 204. The threaded members 205 are shown as threaded nuts and are placed in alignment with apertures 207 formed in the hollow tongue web portion 206 of the vertical mullion 202. A thermal isolator strip 221 is also shown in a bifurcated section above and below the support anchor 200 in position for abutting engagement therewith while being secured to the extruded mouth 223 of the hollow tongue web portion 206 of the present invention.

Figure 3:
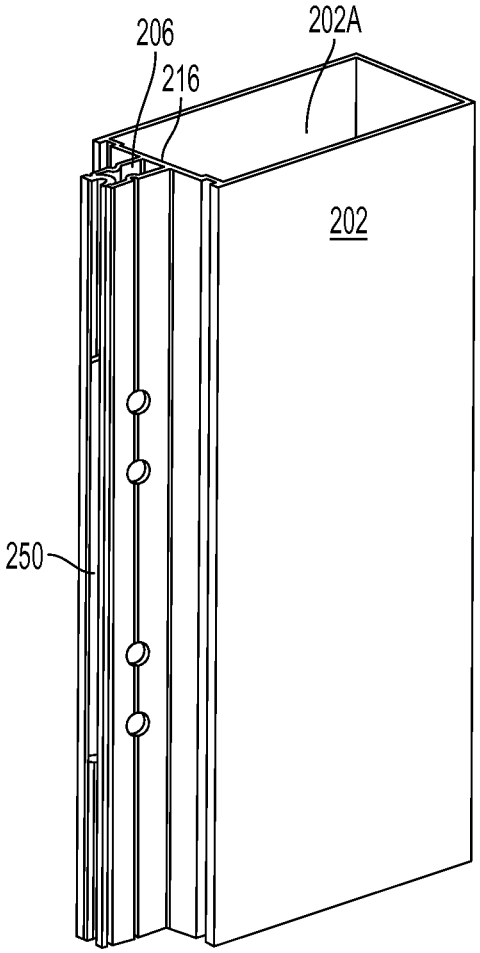
FIG. 3 is a perspective view of the vertical mullion of FIG. 1.

Referring now to FIG. 3, there is shown an isolated perspective view of one embodiment of the vertical mullion 202 and the construction thereof. It may be seen that the hollow tongue web portion 206 is constructed with an inside wall 216 that completely seals the hollow tongue web portion 206 from the inside void 202A of the vertical mullion 202. In this manner, a vertical slot 250 may be cut in the hollow tongue web portion 206 as shown for receipt of the support anchor 200 therein with the mounting apertures thereof in registry with the apertures 237 of the support anchor.

Although the support anchor is illustrated as having four apertures 231 for connecting to other elements, such as sunshades, it will be understood by one skilled in the art that more or fewer than four apertures may be present in any orientation on the support anchor 200. In addition, more or fewer fasteners 204 may be utilized to secure the support anchor 200 to the web portion 206. The support anchor 200 may also be formed in a variety of shapes other than that shown (i.e., rectangular, square, semi-circular, etc.).

Figure 4:
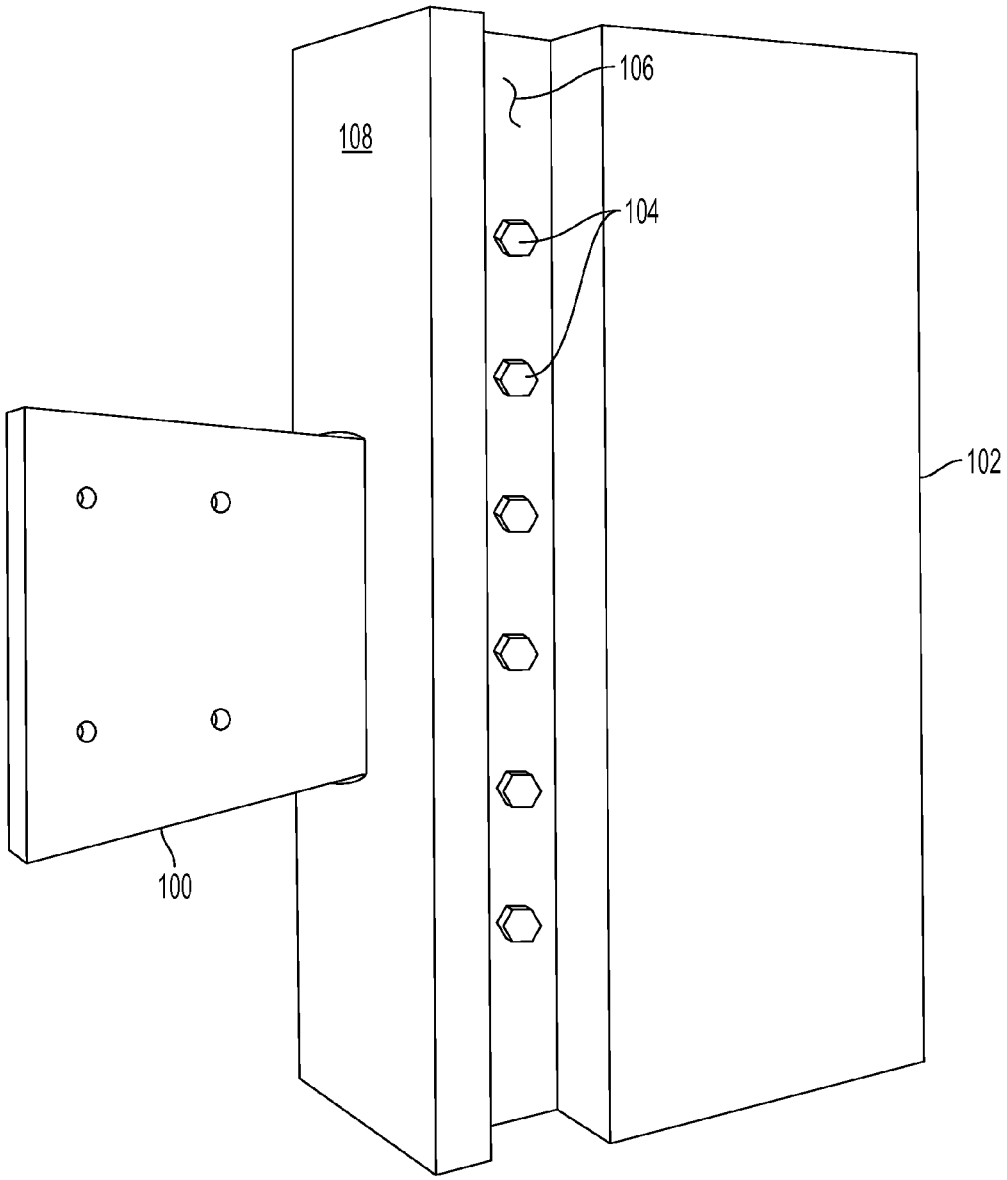
FIG. 4 is a perspective view of an alternative embodiment of a support anchor and vertical mullion in accordance with the principles an embodiment of the present invention.

Referring now to FIG. 4, a support anchor 100 and vertical mullion 102 in accordance with another embodiment of the present invention is illustrated. The support anchor 100 is secured to the vertical mullion 102 with fasteners 104 oriented transversely to tension placed on the support anchor 100. The fasteners 104 secure the support anchor 100 via apertures placed in a web portion 106 of the vertical mullion 102. A face cover 108 may be oriented to cover a portion of the vertical mullion 102 and the support anchor 100.

The support anchor 100 may be utilized to secure sunshades or various other mechanisms to a curtain wall system. The support anchor 100 may be oriented at any portion of the vertical mullion 102 and is not restricted to being fastened to the curtain wall system at an intersection of the vertical mullion and horizontal member. In addition, the support anchor 100 may be retro-fitted to existing curtain wall systems without total disassembly of the system in order to secure fasteners through the vertical mullion void (shown in greater detail in FIG. 5). Instead, to secure the fasteners, a user accesses the web portion 106 of the curtain wall system.

Figure 5:
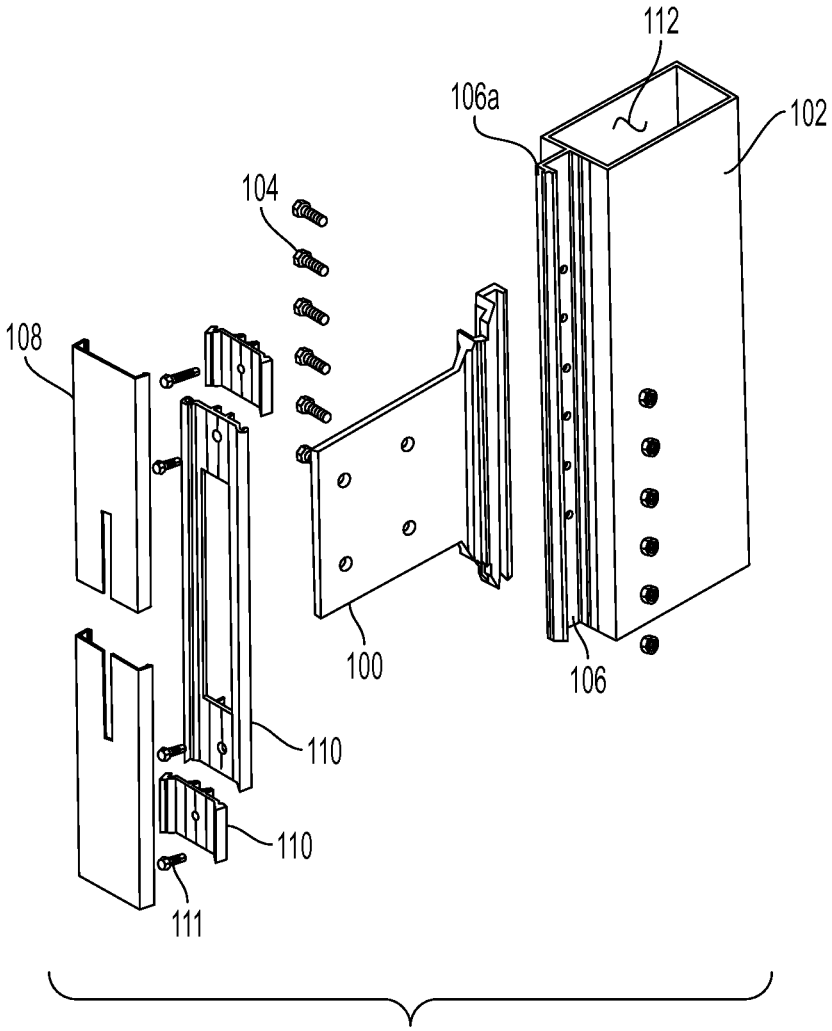
FIG. 5 is an assembly diagram of the support anchor and vertical mullion of FIG. 4.

Referring now to FIG. 5, an assembly diagram of the support anchor 100 and vertical mullion 102 is shown. The support anchor 100 is attached to the web portion 106 of the vertical mullion 102 via fasteners 104 as illustrated above. The face cover 108 is attached by snapping over a pressure plate 110. The pressure plate 110 is attached to the front face 106*a* of the web portion 106 via fasteners 111. By attaching the support anchor 100 to the vertical mullion 102 in this manner, no penetration is made through the vertical mullion into a void 112 thereof. By not penetrating the void 112, additional sealing of the vertical mullion 102 is not necessary when securing the support anchor 100.

Figure 6A:
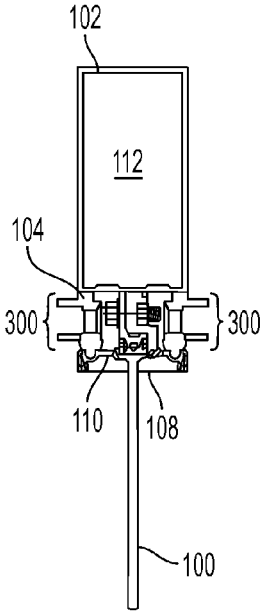
FIG. 6A is a top plan, cross-sectional view of the support anchor and vertical mullion of FIG. 4.
Figure 6B:
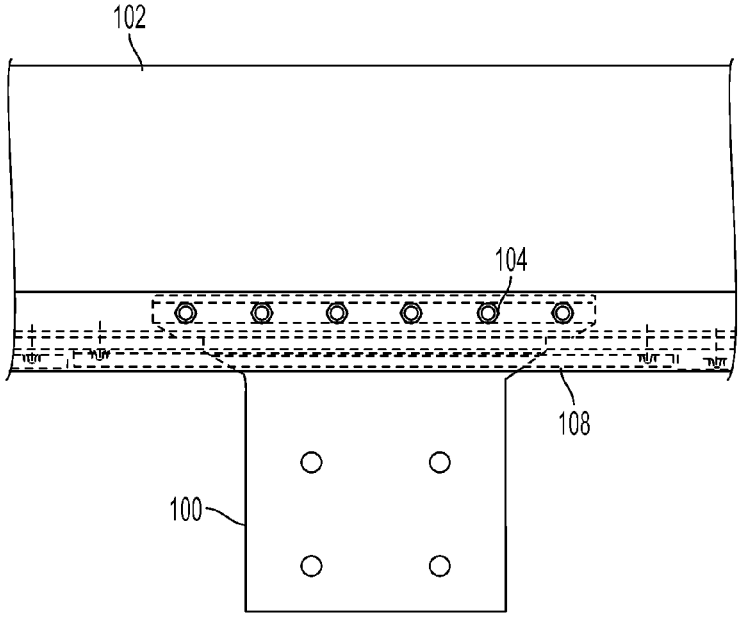
FIG. 6B is a side plan view of the support anchor and vertical mullion of FIG. 4.

Referring now to FIGS. 6A and 6B in combination, the support anchor 100 is shown secured to the vertical mullion 102. The fasteners 104 are oriented such that panel members 300 (e.g., glass panels, marble panels, etc.) may reside within the web portion 106 without causing substantial damage to either the fasteners 104 or the panel members 300. In a preferred embodiment, the panel members 300 are oriented so as to not be in direct contact with the fasteners 104. Alternatively, or in addition, a gasket or padding member may be inserted between the fasteners 104 and the panel members 300 to prevent damage to the panel members 300. The panel members 300 may be held in the web portion 106 with various arrangements that are known in the art and need not be discussed herein.

Figure 7A:
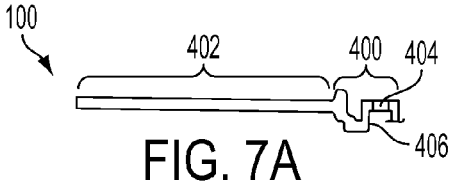
FIG. 7A is a top plan view of a support anchor in accordance with an embodiment of the present invention.
Figure 7B:
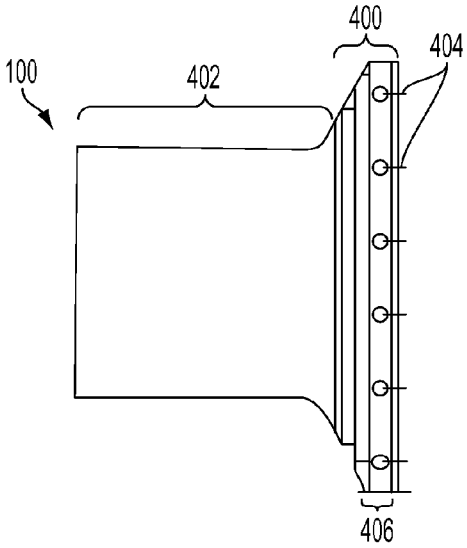
FIG. 7B is a side plan view of the support anchor of FIG. 7A.

Referring now to FIGS. 7A and 7B in combination, the support anchor 100 of an embodiment of the present invention is shown. The support anchor 100 includes a securement portion 400 and an anchor portion 402. The anchor portion 402 may be utilized to support various pieces that may extend from the curtain wall system, such as sun shades. The securement portion 400 is utilized to secure the support anchor 100 to the web portion 106 of the vertical mullion 102. The securement portion 400 is formed in a "hook" orientation to create a positive interlock and increase structural strength. The securement portion 400 includes a plurality of apertures 404 to allow securement of the support anchor 100 via fasteners 104. The apertures 404 may be prefabricated along with apertures of the anchor portion 402 and the web portion 106. Alternatively, apertures of the web portion 106 and support anchor 100 may be created at the job site.

The apertures 404 of the securement portion 400 are formed within a channel 406. The channel 406 may be sized as to create self-locking of the nuts of the fasteners 104.

Figure 8:
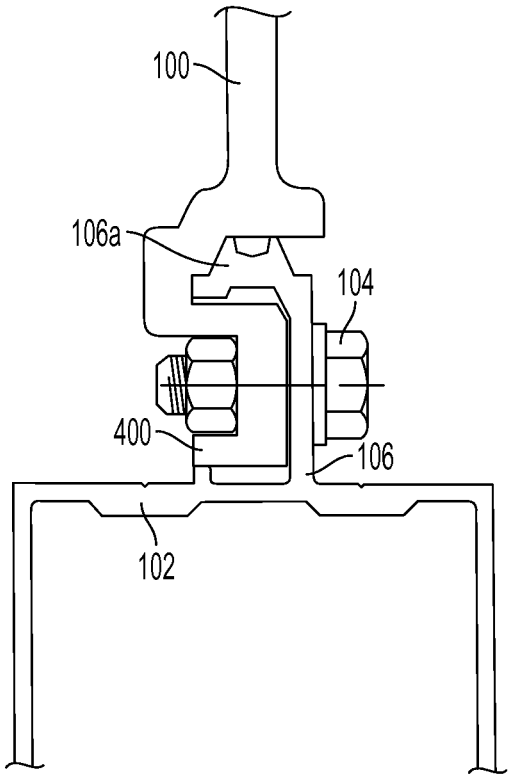
FIG. 8 is a top plan view of the support anchor and vertical mullion of FIG. 4.

Referring now to FIG. 8, a detailed top view of the support anchor 100 secured to the web portion 106 of the vertical mullion 102 is shown. The securement portion 400 of the support anchor 100 is oriented around a front face 106*a* of the web portion 106 and against a surface of the web portion 106. As shown the fasteners 104 are oriented substantially transversely to a tension force T (indicated by an arrow) created at the support anchor 100. In contrast to fasteners oriented inline with the tension force T, the fasteners 104 of embodiments of the present invention may not be pulled out due to the tension force T.

Figure 9:
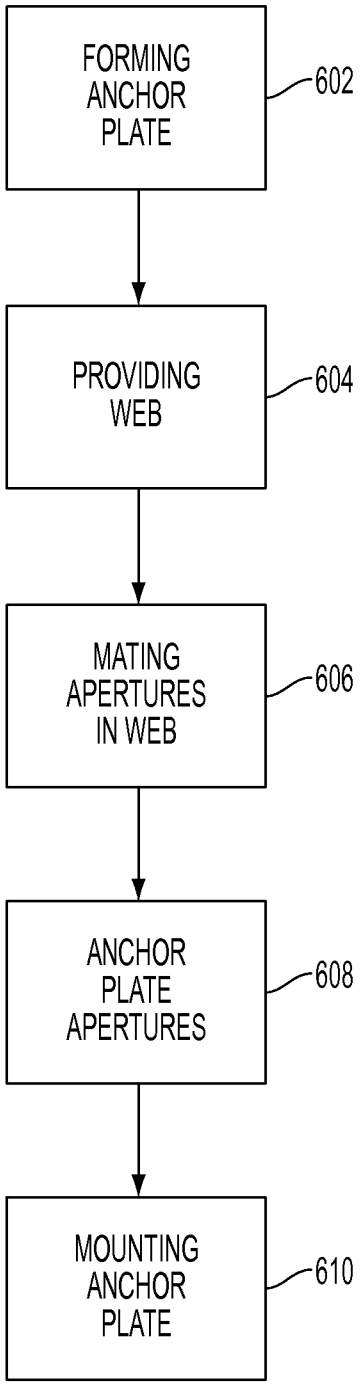
FIG. 9 is a flow chart of one embodiment of certain methods of the present invention.

Referring now to FIG. 9, there is shown a flowchart of one embodiment of certain methods of the present invention. In the embodiment shown, the method is presented for supporting structures outwardly of the curtain wall of the type of vertical mullions formed with web sections extending outwardly thereof. The steps include forming (602) an anchor plate adapted to mount with the web section of the curtain wall and extend outwardly therefrom for support of structures therewith. The steps further include providing (604) the web with one of a hollow tongue configuration and an external flange portion, the web having a first set of fastening apertures formed therethrough. In step 606 the anchor plate is provided with a first set of mating apertures adapted for a registry with the first set of fastening apertures. In step 608 the anchor plate is provided with a second set of apertures for securing such structures outwardly of the curtain wall. Finally, step 610 comprises mounting the anchor plate into the web section of the curtain wall and securing the mounting thereof with threaded fasteners extending through the first set of fastening apertures formed in the web.

Figure 10:
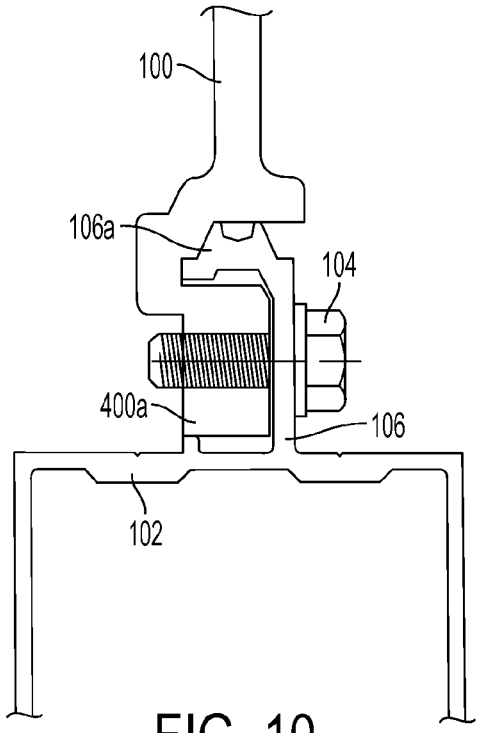
FIG. 10 is a top plan view of an alternative embodiment of the present invention.
Figure 11:
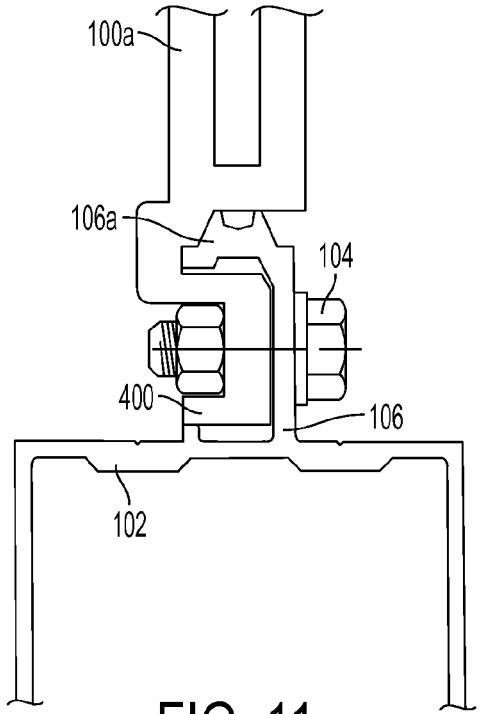
FIG. 11 is a top plan view of a further alternative embodiment of the present invention.

Referring now to FIGS. 10 and 11, there are shown alternative embodiments of the present invention. In FIG. 10, a top view of the support anchor 100 secured to the web portion 106 of the vertical mullion 102 is shown. In this particular embodiment, the fastener 104 threadably engages the support anchor 100 with the support anchor 100 having a threaded aperture formed therethrough for receipt of the threaded fastener 104 therein. It may be seen that the securement portion 400, in this particular embodiment, is thicker than that shown in FIG. 8 and fully threaded for the receipt of the threaded fastener 104 therein. Likewise, in FIG. 11, the alternative embodiment includes a variation in the support anchor, wherein a support anchor 100A is shown with a pair of support plates in generally parallel-spaced relationship. Support anchor 100A is shown for purposes of illustrating the fact that variations in the shape, size and configuration of the support anchor may be made in accordance with the principles of the present invention.

Although the support anchor is illustrated as having four apertures for connecting to other pieces, such as sunshades, it will be understood by one skilled in the art that more or less than four apertures in any orientation may be present on the support anchor. In addition, more or less fasteners may be utilized to secure the support anchor 100 to the web portion 106. The anchor portion may also be formed in a variety of shapes other than that shown (i.e., rectangular, square, semicircular, etc.). Furthermore, the securement portion may be oriented in a variety of shapes other than the "hook" orientation shown. For example, a forked securement portion may be utilized without departing from aspects of the present invention. The face plate may or may not be utilized in accordance with aspects of the present invention.

While exemplary embodiment(s) of the present invention have been described, it should be recognized that the invention can be varied in many ways without departing therefrom. Because the invention can be varied in numerous ways, it should be understood that the invention should be limited only insofar as is required by the scope of the following claims.

What is claimed:

1. A curtain-wall mounting system adapted for cantilevered support of at least one structure outwardly of a curtain wall, the curtain-wall mounting system comprising:

a curtain-wall web section comprising:

a hollow-tongue web extending outwardly from a curtain-wall vertical mullion in a first direction; and a first set of fastening apertures oriented transversely to the first direction and formed through the hollow tongue web, the first set of fastening apertures extending entirely through a width of the hollow-tongue web;

at least one anchor plate that integrally mounts to the curtain-wall web section, the anchor plate comprising:

a body portion oriented for receipt into the hollow-tongue web, the body portion comprising a first set of mating apertures that align in registry with the first set of fastening apertures;

a flange portion;

a shoulder portion disposed between the body portion and the flange portion; and a second set of mounting apertures that secure structures outwardly therefrom; and wherein the body portion is received into the hollow-tongue web such that the shoulder portion abuts the hollow-tongue web and the first set of mating apertures align with the first set of fastening apertures.

2. The curtain-wall mounting system of claim 1 wherein the first set of fastening apertures of the curtain-wall web section receives threaded fasteners therethrough.

3. The curtain wall mounting system of claim 2 wherein the fastening apertures of the hollow-tongue web are threaded.

4. The curtain wall mounting system of claim 2 wherein the mating apertures of the anchor plate are threaded.

5. The curtain-wall mounting system of claim 1 comprising:

a face cover having a first slotted portion therethrough constructed to receive the at least one anchor plate therein; and a pressure plate having a second slotted portion therethrough constructed to receive the at least one anchor plate therein, the pressure plate being disposed between the shoulder portion of the at least one anchor plate and the face cover.

6. The curtain-wall mounting system of claim 1 further comprising a trim plate having a slotted portion constructed to receive the at least one anchor plate therethrough and engage the curtain-wall web section with the at least one anchor plate extending outwardly therefrom.

7. The curtain wall mounting system of claim 1 wherein the hollow-tongue web is a flange, the flange comprising an extruded section with at least one orthogonal flange portion thereof and wherein the anchor plate includes a mating section having at least one orthogonal section adapted for mating engagement with the orthogonal flange portion of the extruded section.

8. The curtain-wall mounting system of claim 1 wherein the curtain-wall web section comprises a plurality of aligned apertures constructed to receive threaded fasteners, the plurality of aligned apertures comprising the first set of fastening apertures.

9. The curtain-wall mounting system of claim 1 wherein the anchor plate comprises a second flange portion oriented generally parallel to the flange portion.

10. A method of supporting structures outwardly of a curtain wall, the method comprising:

forming an anchor plate constructed to mount with a web section of the curtain wall and extends outwardly therefrom in a first direction for support of structures therewith, the anchor plate comprising a body portion, a flange portion, and a shoulder portion disposed between the body portion and the flange portion;

providing the web section formed with a hollow-tongue web, the web section comprising a first set of fastening apertures oriented transversely to the first direction and formed through the web section, the first set of fastening apertures extending entirely through a width of the web section;

wherein the body portion comprises a first set of mating apertures adapted for registry with the first set of fastening apertures;

wherein the flange portion comprises a second set of apertures for securing structures outwardly of the curtain wall;

receiving the body portion into the hollow-tongue web such that the shoulder portion abuts the web section; and securing the body portion within the hollow-tongue web.

11. The method of claim 10 further comprising constructing the first set of fastening apertures of the web section for receiving a plurality of threaded fasteners therethrough.

12. The method of claim 11 further comprising providing a face cover.

13. The method of claim 10 further comprising forming the first set of fastening apertures for receipt of a plurality of bolts therethrough for securement of the anchor plate within the hollow tongue web.

14. The method of claim 10 and further including providing a trim plate having a slotted portion adapted for the receipt of the anchor plate therethrough and the step of engaging the hollow-tongue web with the anchor plate extending outwardly therefrom.

* * * * *